US005115657A

United States Patent [19]

Del Fabro

[11] Patent Number: 5,115,657

[45] Date of Patent: May 26, 1992

[54] COMBINED ASSEMBLY TO STRAIGHTEN AND LINEARISE SECTIONS

[75] Inventor: Giorgio Del Fabro, Cassacco-Fraz.Montegnacco, Italy

[73] Assignee: M.E.P. Macchine Elettroniche Piegatrici, Reana Del Rojale, Italy

[21] Appl. No.: 589,609

[22] Filed: Sep. 28, 1990

[30] Foreign Application Priority Data

Oct. 17, 1989 [IT] Italy ..... 83483 A/89

[51] Int. Cl.[5] ..... B21D 3/02

[52] U.S. Cl. ..... 72/164; 72/162

[58] Field of Search ..... 72/160-165

[56] References Cited

U.S. PATENT DOCUMENTS

| | | | |
|---|---|---|---|
| 2,343,899 | 3/1944 | Groll | 72/160 |
| 3,374,653 | 3/1968 | Zeigler | 72/161 |

FOREIGN PATENT DOCUMENTS

| | | | |
|---|---|---|---|
| 368725 | 3/1982 | Austria . | |
| 8625 | 3/1980 | European Pat. Off. . | |
| 269157 | 6/1988 | European Pat. Off. . | |
| 3729619 | 3/1989 | Fed. Rep. of Germany . | |
| 1054263 | 2/1954 | France | 72/161 |
| 2115151 | 7/1972 | France . | |
| 2252879 | 6/1975 | France . | |
| 2471 | 5/1962 | Japan | 72/162 |
| 115328 | 6/1985 | Japan | 72/160 |
| 98121 | 3/1923 | Switzerland . | |
| 437978 | 11/1967 | Switzerland . | |
| 772647 | 8/1981 | U.S.S.R. . | |
| 1138219 | 10/1985 | U.S.S.R. . | |
| 1344454 | 5/1988 | U.S.S.R. . | |
| 2085774 | 5/1982 | United Kingdom . | |

*Primary Examiner*—Daniel C. Crane

*Attorney, Agent, or Firm*—Antonelli, Terry Stout & Kraus

[57] ABSTRACT

Combined assembly to straighten and linearise sections (11), which have a solid or hollow cross section and may include externally a round or ribbed surface, or projections, or helicoidal TOR ribs, or a three-lobed or cross-shaped or star-shaped cross section, etc., the sections being in the form of bars or wound bundles (12), the assembly comprising, in positions lying substantially on the same plane, a first straightening unit (20) having immediately upstream and immediately downstream respectively an inlet feeder unit (14) and an outlet feeder unit (21), and comprising also a second straightening unit (23) having downstream an orthogonal regulation unit (24) followed by a contrast unit (27), the second straightening unit (23) being positioned on a path of the sections (11) which includes an S-shaped or Z-shaped bend (22).

10 Claims, 1 Drawing Sheet

COMBINED ASSEMBLY TO STRAIGHTEN AND LINEARISE SECTIONS

This invention concerns a combined assembly to straighten and linearise sections.

According to the invention such sections may have a cross section which is not homogeneous, and may consist of ribbed rods, rods including projections, rods with TOR helicoidal ribs, three-lobed rods, rods with a cross-shaped or star-shaped cross section, straight or twisted rods, etc. The invention can also be applied to hollow tubes.

The invention is applied advantageously to sections fed from wound bundles but can also be applied to sections in the form of bars.

The invention is applied properly to all cases where the section tends to rotate about its axis during the straightening step owing to its geometric structure and/or to its manufacturing and/or coiling processes.

The invention is employed in the straightening of sections having a round or equivalent cross section with a diameter between 4 mm. and 18 mm.

It is known that a section produced by cold or hot processing and having a solid or hollow tubular cross section undergoes progressive changes of its initial cross section through distortions which increase gradually during the rolling process owing to the wear of the rolling rolls or rings.

The original rolling conditions are only restored by replacement of the rolling rolls or rings.

It is also known that to the circumference of a solid, or hollow tubular, section leaving a winding machine is imparted a rotation which depends on the direction of rotation of the winding machine. This circumferential rotation causes a twisting of the section, the pitch of the twisting being variable.

This twist is fixed in the product when the latter has been wound in a bundle, and the fixation becomes more marked when the product has been wound in a bundle while still hot and becomes cool while still wound.

This twist remains or increases during unwinding, depending on the system used to unwind the product from the bundle.

Lengthwise ribs which lie on a straight plane passing in the neighbourhood of the axis of the rod are produced in a round rod, for instance intended for building work, during the rolling step. After being wound in a bundle, the rod comprises ribs lying on a plane of which the development is helicoidal and passes in the neighbourhood of the axis of the rod.

It is also known that in a section having a solid or hollow cross section non-homogeneous forces may occur and be fixed and may induce an auxiliary twist on the axis of the section. This auxiliary twist may also affect only segments of the section and will be added algebraically to the twists caused by the winding into a bundle and by the unwinding.

These twists together with the non-homogeneous cross section induce in the section during the straightening step a variable reaction with a movement of rotation of the section about its axis. This discontinuous movement of the section about its axis during the straightening step does not have a constant sign or intensity along the whole section.

Such lack of structural continuity has the effect that with the present methods the section is never straightened satisfactorily.

Moreover, when such a straightened section is employed to obtain required geometric shapes, such as shaped rods for building work for instance, these required geometric shapes are hard to obtain in forms like or equal to the theoretical geometric shapes owing to the tensions which remain in the section and which the straightening operation has neither eliminated nor fixed.

Manifold systems have been disclosed for obviating the above shortcomings.

U.S. Pat. No. 299,615 discloses a plurality of rolls positioned in the form of a spiral and carrying out the straightening function; these rolls in their assembly rotate about an imaginary axis of the wire. This system may be satisfactory for processing wire but is unable to prevent rotation of the section about its axis and is unsuitable to process a very wide range of shapes.

U.S. Pat. No. 731,675 discloses a straightening machine that serves to straighten T-shaped or L-shaped sections, starting with bars. This invention not only deals with a product not of interest to our invention but also discloses a plurality of rollers positioned at an angle and processing a section kept substantially linear.

GB 124,574 discloses a straightening machine having sleeves that rotate about the axis of the product to be straightened, the sleeves being positioned as desired within a rotary support conduit. This invention can work where wire rod is to be straightened and the speeds are relatively low, but becomes unusable where it is necessary to straighten sections of the type indicated in the preamble of this text.

U.S. Pat. No. 2,084,746 discloses a straightening machine in which roller-type rotors are employed to guide the section better. This system possesses the same limits as U.S. Pat. No. 299,615.

U.S. Pat. No. 2,720,243 discloses a straightening machine for sections which is able to process only those sections of which the geometric shape enables the rollers to offer a secure guide.

U.S. Pat. No. 3,068,931 discloses a straightening machine with rotary mandrels, the machine being unsuitable to process sections or products already comprising substantial twists.

FR 1.469.905 discloses the straightening of sections by means of a rotary sleeve system. To do so, it provides straightening means which in one segment of the straightening machine are positioned so as to impart a circular or oval development. This system may be suitable for hollow tubular or solid bodies which have a square or rectangular cross section and are already substantially linear without induced twists.

FR 2.138.615 discloses a plurality of roller assemblies positioned at the vertices of a plurality of triangles rotated in relation to each other. This method does not enable the rotation of sections of the type indicated in the preamble about their axis to be prevented.

EP-A-86102121.0 in the name of the present applicant discloses a plurality of straightening assemblies arranged at an angle to each other and also positioned on more than one plane.

This system ensures that the section does not rotate about its axis, but is very costly to construct and hard to embody and regulate, besides taking up a great deal of space. Moerover, while it does not permit rotation, it does not provide the required quality, nor a constant degree, of straightening.

To prevent rotation of the section about its axis during the straightening step, it is also possible to employ a two-gripper drawing system whereby one gripper is always holding the section so as to prevent its rotation.

This system is very slow and does not ensure proper handling of the various types of section cited in the preamble.

EP-A-87202107.6 in the name of the present applicant discloses a method and a rotation prevention straightening machine to straighten sections, whereby the sections are diverted along loops during the straightening step.

The actual straightening step itself is preceded by a pre-straightening step and is followed by a linearisation and finishing step.

The results of this working configuration are acceptable but have still not satisfied fully the present applicant, who has designed, tested and embodied an improved straightening system able to meet even the most demanding requirements.

The purpose of this invention is to accomplish the straightening of sections having a round or equivalent cross section with a diameter between 4 mm. and 18 mm., whether the sections are solid or hollow, without the sections having to rotate on their axis and without the inner and outer structures of the sections having to undergo changes.

Another purpose of this invention is to be able to straighten with the same equipment sections having as their cross section a plurality of different geometric figures with different cross sections.

A further purpose of this invention is to improve the drawing of the section during the straightening step.

Yet another purpose is to achieve the straightening of the section in any angular position of the same even though the cross section has lengthwise, along the plane passing through its centre and through that angular position, a geometric configuration differentiated along that plane.

The invention also has the purpose of providing a linearisation action for the straightened section.

The invention has the further purpose of carrying out a straightening action with an apparatus all of which lies substantially on the same plane.

The invention is set forth in the main claim, whereas the dependent claims describe various features of the invention.

The combined straightening and linearisation assembly according to the invention comprises a first straightening unit with a substantially straight path for the section.

This first straightening unit is immediately downstream of an inlet feeder unit and immediately upstream of an outlet feeder unit.

A bend with a desired, controlled development is imparted to the section as it leaves the first straightening unit.

By bend is meant here an S-shaped or Z-shaped bend which is joined to an entry and an exit that lie on the same plane but are substantially parallel.

Along this bend is arranged a second straightening unit, which prevents the section from rotating about its own axis.

At least one of the rolls of each pair of rolls of the above units is powered so as to ensure that the section is always being drawn during the straightening.

According to a variant at least one of the central rolls of the first straightening unit which are not able to move vertically is able to move axially so as to act as a stretching means and a means to fix the twists.

At the end of the curved segment of the path of the section are applied the forces required to linearise and finish the section, that is to say, to provide it with a linearity free of faults. This is achieved with an orthogonal regulation unit that cooperates with a successive contrast unit.

The combined assembly of the invention, from the inlet feeder unit to the terminal contrast unit, is developed substantially on one and the same plane.

According to a variant a static deviator able to assist the movement of the section being inserted is included at the outlet and possibly at the inlet of the first straightening unit and is solidly fixed to the assembly of vertically movable upper rolls.

These and other special features of the invention will be made clearer in the description which follows.

The attached figures, which are given as a non-descriptive example, show the following:

The figures show a combined straightening and linearisation assembly 10, according to the invention, as applied to a section 11 being unwound in this example from a bundle 12 wound on a rotary reel 13 of a known type.

During the step of winding the section 11 on the reel 13 and depending on the type of the winding, a twist may have been imparted to the section 11 and may have made the development of the lengthwise fibres spiral-shaped, and therefore any possible ribs too which during the rolling step and more generally during the readying step were parallel to the axis of the section may have been made spiral-shaped.

When the section 11 is unwound from its bundle 12 or reel, its spiral-shaped development remains or is enhanced, depending on the method of the unwinding.

Figure 1:
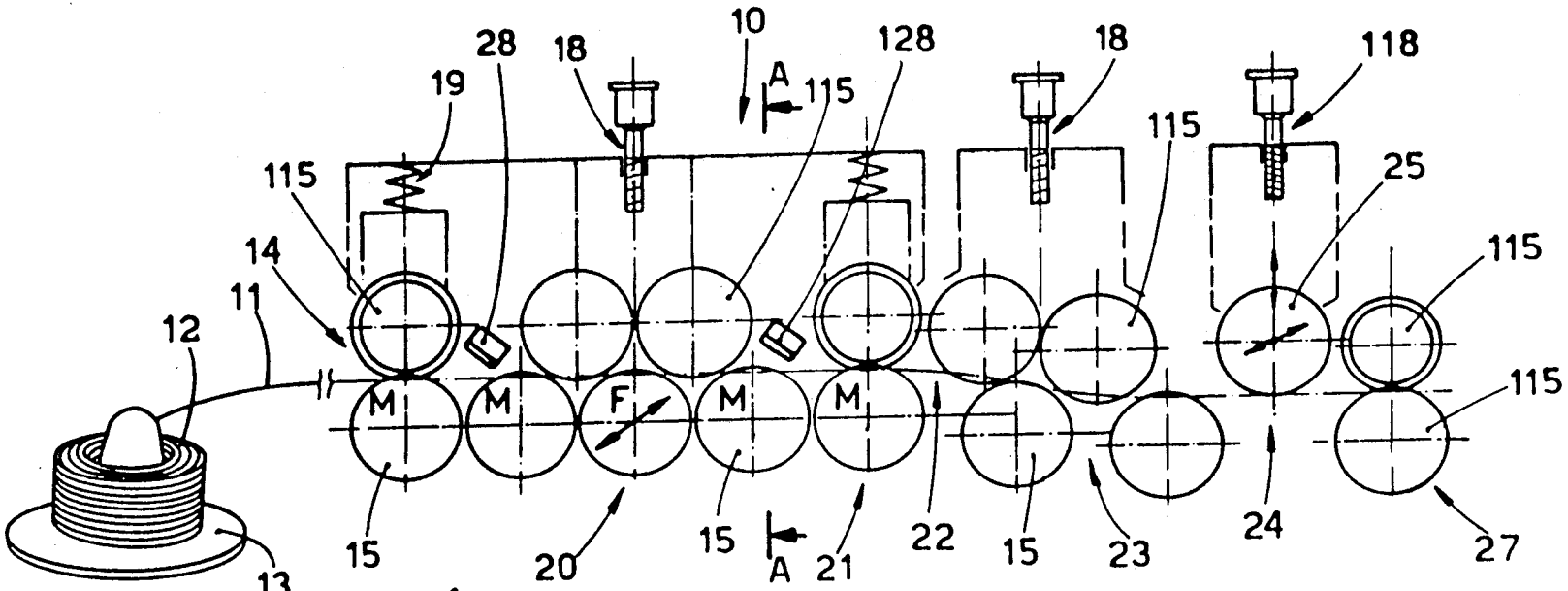
FIG. 1 is a side diagrammatic view of a combined assembly to straighten and linearise sections according to the invention.
Figure 2:
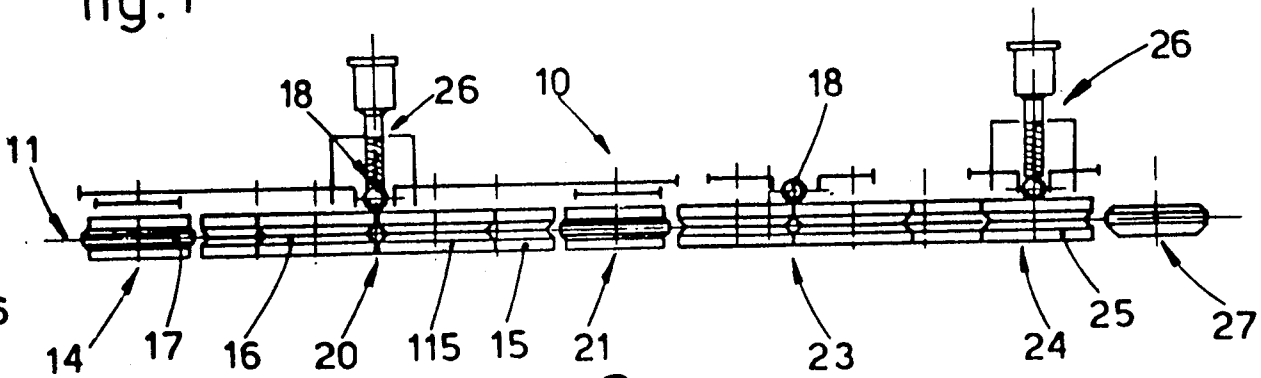
FIG. 2 is a plan view of the assembly of FIG. 1.

According to the invention the section 11 is firstly sent into an inlet feeder unit 14 consisting of a pair of rolls 15-115. The lower roll 15 of the unit 14 is powered and is marked with the letter "M" in FIG. 1.

The upper 115 and lower 15 rolls of the unit 14 are positioned facing each other and comprise channels 16 to hold the section 11. These channels 16 enable each roll 15-115 to obtain at least two points of contact, with a resulting retaining and lateral fixture action such as to make unnecessary the inclusion of orthogonal rolls during the straightening.

A configuration is provided advantageously by which one roll has its containing channel 16 shaped with an angle of about 90° at the vertex of the channel, while the other paired roll has a mating peripheral projection 17 which cooperates with the containing channel 16.

The idler roll 115 is connected to a system 18 for vertical setting of the working position of the roll 115 in relation to the section 11. This setting may be applied to the roll 115 alone or may form part of a system for setting other rolls too, as we shall see hereinafter.

The idler roll 115 of the inlet unit 14 advantageously comprises pressure means too 19, which exert an action of a constant or variable value, as required, on the section 11.

Next, a first straightening unit 20 consists of lower rolls 15 and upper rolls 115, in this example three lower rolls 15 and two upper rolls 115.

The upper rolls 115 of the first straightening unit 20 are movable idler rolls, while of the lower rolls 15 two are stationary and at least one central roll can move axially.

Of the lower rolls 15 of the first straightening unit 20 the stationary rolls marked with "M" are powered, while in this example the axially movable roll marked with "F" is an idler roll.

The first straightening unit 20 processes the section 11 arranged on a substantially straight path.

As we said above, the lower axially movable roll 15F is advantageously an idler roll, while the other two rolls 15M are powered.

As the lower idler roll 15F can be moved axially by a device 26, this roll can also act in a direction normal or at an angle to the plane on which the rolls lie, thus providing an action of further stretching and fixture of the twists existing at that point in the section 11 passing through the unit 20.

The upper rolls 115 can move on the plane on which the rolls lie, and are idler rolls. They can be moved simultaneously by means of a setting system 18.

The lower 15 and upper 115 rolls of the first straightening unit 20 are staggered in relation to each other in a position required to ensure a very good grip on the section 11 along its path.

Figure 3:
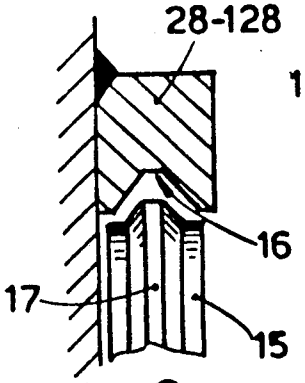
FIG. 3 shows a partial cross section along the line A—A of FIG. 1.

According to the invention deviators 28 and 128 respectively are comprised in cooperation with the inlet and/or outlet of the first straightening unit 20 and are shown diagrammatically in FIG. 3; these deviators 28 and/or 128 are solidly fixed to a plate that serves to move the upper idler rolls 115.

The section 11 encounters thereafter an outlet feeder unit 21, which has characteristics analogous to those of the inlet feeder unit 14 and includes a lower powered roll 15 which is therefore marked with the letter "M".

The inlet 14 and outlet 21 feeder units, besides their drawing action, exert on the section 11 a compression action suitable to linearise the section 11, thus substantially eliminating the ribs along a defined line and enabling the successive measurement of the section 11 by a contrast and measurement unit 27 to be carried out without problems.

The section 11 leaving the outlet feeder unit 21 is passed along a bend 22, which in this example turns downwards (Z-bend) but could turn upwards equally well (S-bend).

In the configuration shown the outlet feeder unit 21 is positioned at the highest point of the bend 22, whereas a second straightening unit 23 works on the path of the bend 22.

In this example the second straightening unit 23 consists of two reciprocally staggered pairs of rolls 15–115; the first pair 15–115 is located on one portion of the bend 22, whereas the second pair 15–115 is positioned on the lower portion of the bend 22.

The second straightening unit 23 too is connected to a vertical setting system 18.

On leaving the bend 22 the section 11 encounters an orthogonal regulation unit 24 consisting of an adjusting roll 25 in this example.

The adjusting roll 25 is able to be moved by a vertical setting unit 118 and a horizontal setting unit 26 in four directions according to the two cartesian axes contained in a plane substantially normal to the axis of the section 11.

The orthogonal regulation unit 24 lies substantially on the same plane as the feeder units 14–21 and straightening units 20–23 mentioned above and enables the section 11 to be correctly linearised in cooperation with a contrast unit 27 positioned immediately downstream.

The contrast unit 27 consists of a pair of facing rolls 115 and can perform advantageously the task of a measurement unit as well.

Depending on the position taken up by the orthogonal regulation unit 24, the section 11 leaving the contrast and possible measurement unit 27 takes up any three-dimensional position within a conoid the vertex of which lies between the rolls 115 of the contrast unit 27.

I claim:

1. A combined assembly to straighten and linearise a section in the form of a bar or rod from wound bundles being fed through said combined assembly comprising:

a first straightening unit comprising a plurality of upper rolls opposed to and staggered with a plurality of lower rolls;

inlet feeder means for feeding said section to said first straightening unit and being provided immediately upstream of said first straightening unit;

outlet feeder means for withdrawing said section from said first straightening unit and being provided immediately downstream of said first straightening unit;

a second straightening unit comprising a plurality of upper rolls opposed to and staggered with a plurality of lower rolls, said second straightening unit being provided downstream of said outlet feeder means;

a contrast unit comprising opposing upper and lower rolls and being provided downstream of said second straightening unit; and orthogonal regulation means for contacting said section and directing said section laterally along two orthogonal directions normal to an axis of said section, said orthogonal regulation means being provided between said second straightening unit and said contrast unit;

wherein said inlet feeder means, said first straightening unit, said outlet feeder means, said second straightening unit, said orthogonal regulation means, and said contrast unit are positioned so as to feed said bar or rod on substantially a single plane throughout the combined assembly; and wherein a bend is imparted to said section at least between said outlet feeder means and an entrance of said second straightening unit such that said section bends upwardly or downwardly and wherein said second straightening unit is positioned on a path of said section including said bend.

2. A combined assembly according to claim 1, wherein each of the inlet feeder means and outlet feeder means consists of a pair of opposing rolls, at least one of said pair of opposing rolls being stationary and powered.

3. A combined assembly according to claim 1, wherein at least one of said plurality of rolls of said first straightening unit can move on its own axis of revolution.

4. A combined assembly according to claim 2, further comprising resilient pressure means for resiliently pressing the other of said pair of rolls of said inlet feeder means and said outlet feeder means towards said section.

5. A combined assembly according to claim 1, wherein said orthogonal regulation means comprises a regulation roll and means for moving said regulation roll along its axis of revolution and in an orthogonal direction normal to an axis of the section.

6. A combined assembly according to claim 1, wherein said contrast unit includes means for measuring said sections.

7. A combined assembly according to claim 2, wherein one of said pair of rolls of said inlet feeder means includes a circumferential channel to contact said section and the other of said pair of rolls of said inlet feeder means includes a peripheral projection which cooperates with said channel to laterally fix said section.

8. A combined assembly according to claim 2, wherein one of said pair of rolls of said outlet feeder means includes a circumferential channel to contact said section and the other of said pair of rolls of said outlet feeder means includes a peripheral projection which cooperates with said channel to laterally fix said section.

9. A combined assembly according to claim 1, further comprising means for laterally fixing said section between said upper and lower rolls of said first straightening unit and said second straightening unit.

10. A combined assembly according to claim 9, wherein said means for laterally fixing said section between said upper and lower rolls of said first straightening unit and of said second straightening unit comprises a circumferential channel to contact said section in each of said upper and lower rolls.

* * * * *